United States Patent [19]

Takeuji

[11] Patent Number: 4,868,362

[45] Date of Patent: Sep. 19, 1989

[54] MICROWAVE OVEN WITH CIRCUIT COOLING SYSTEM AND MAGNETIC SHIELD SYSTEM

[75] Inventor: Koichi Takeuji, Nara, Japan

[73] Assignee: Sharp Kabushiki Kaisha, Osaka, Japan

[21] Appl. No.: 312,412

[22] Filed: Feb. 13, 1989

Related U.S. Application Data

[63] Continuation of Ser. No. 609,886, May 14, 1984, abandoned, which is a continuation of Ser. No. 127,848, Mar. 6, 1980, abandoned.

[30] Foreign Application Priority Data

Mar. 6, 1979 [JP] Japan ..... 54-28803

[51] Int. Cl.[4] ..... H05B 6/64

[52] U.S. Cl. ..... 219/10.55 R; 219/10.55 B; 361/384; 361/424; 336/84 C

[58] Field of Search ..... 219/10.55 R, 10.55 B, 219/10.55 D; 174/35 R, 35 MS, 15.1, 16.1, 16.3; 361/383, 384, 424, 394, 395; 336/84 R, 84 C, 84 M

[56] References Cited

U.S. PATENT DOCUMENTS

| | | | |
|---|---|---|---|
| 2,512,138 | 6/1950 | Butt | 174/35 R X |
| 2,682,018 | 6/1954 | Phillips | 336/84 C X |
| 3,365,621 | 1/1968 | Von Fange et al. | 361/424 |
| 3,569,656 | 3/1971 | White et al. | 219/10.55 B |
| 3,912,849 | 10/1975 | Thomas | 361/424 X |
| 4,035,794 | 7/1977 | Norton et al. | 336/84 M X |
| 4,336,569 | 6/1982 | Tsuda et al. | 219/10.55 B |
| 4,339,646 | 7/1982 | Doi et al. | 219/10.55 B |
| 4,812,617 | 3/1989 | Takeuji et al. | 219/10.55 R |

FOREIGN PATENT DOCUMENTS

| | | | |
|---|---|---|---|
| 54-14039 | 2/1979 | Japan | 219/10.55 R |

OTHER PUBLICATIONS

Ad. Brochure, Toshiba's "Brainwave", Feb. 1979, four pages.

*Primary Examiner*—Philip H. Leung
*Attorney, Agent, or Firm*—Birch, Stewart, Kolasch & Birch

[57] ABSTRACT

A microwave oven comprises a cooling system and a magnetic shield system applied to a plurality of circuit elements. The cooling system comprises a compartment through which air can pass. The compartment is formed by at least one printed circuit board carrying a plurality of circuit elements and a supporting member for supporting the printed circuit board. The circuit elements are cooled by the flow of the air. In addition, the circuit elements are magnetically shielded from a magnetic field generation device such as a magnetic card reader/-writer and a high voltage transformer by a shield member. It is possible that the circuit elements are protected from very large quantities of heat emitted by the high voltage transformer. The magnetic card reader/writer may be provided for reading/cooking program information from a magnetic card and writing the same on it. The microwave oven should be controlled according to the cooking program information for cooking purposes.

4 Claims, 2 Drawing Sheets

MICROWAVE OVEN WITH CIRCUIT COOLING SYSTEM AND MAGNETIC SHIELD SYSTEM

This application is a continuation of application Ser. No. 609,886 filed on May 14, 1984 which is a continuation application of Ser. No. 127,848, filed Mar. 6, 1980, both now abandoned.

BACKGROUND OF THE INVENTION

The present invention relates to a construction of a microwave oven and, more particularly, to a cooling system and a magnetic shield system for a microwave oven or a combined electric heating oven and microwave oven.

Recently, a semiconductor chip has been incorporated within a heating appliance such as a microwave oven. The semiconductor chip is adapted to control the heating appliance as-shown in T. KAWABATA et al, Ser. No. 792,222 "MICROWAVE OVEN WITH A PROGRAMMABLE DIGITAL CONTROL CIRCUIT" filed on Apr. 29, 1977, U.S. Pat. No. 4, 255,639 assigned to the present assignee. The semiconductor chip has a tendency to be easily damaged by heat evolved within the housing of the heating appliance. The heat problem imparted to the semiconductor chip to results in a mismanagement of the heating appliance.

Furthermore, the microwave oven has evolved to the present stage wherein a magnetic card is used to provide input cooking information according to which the microwave oven is energized. Such a microwave oven was disclosed in a copending U.S. patent application Ser. No. 974,037, entitled "MAGNETIC CARD CONTROL MICROWAVE OVEN" filed on Dec. 27, 1978 by K. DOI et al, assigned to the present assignee.

In such a magnetic card-controlled microwave oven, it is required that a plurality of circuit elements inclusive of the semiconductor chip be protected magnetically from a high-voltage transformer disposed within the magnetic card-controlled microwave oven.

SUMMARY OF THE INVENTION

Accordingly, it is the primary object of the present invention to provide a novel arrangement to provide a novel cooling system and magnetic shield system useful for a circuit element operable for a microwave oven.

It is another object of the present invention to provide an improved microwave oven having a novel cooling system and magnetic shield system both applied to a circuit element operable for itself.

It is still another object of the present invention to provide an improved microwave oven having a novel screen member for providing cooling properties and magnetic shield properties both applied to a control circuit element operated to activate itself.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a microwave oven comprises a cooling system and a magnetic shield system applied to a plurality of circuit elements. The cooling system comprises a compartment through which air can pass. The compartment is formed by at least one printed circuit board carrying the plurality of circuit elements and a supporting member for supporting the printed circuit board. The circuit elements are cooled by the flow of the air. In addition, the circuit elements are magnetically shielded from a magnetic field generation device such as a magnetic card reader/writer and a high voltage transformer by a shield member. It is possible that the circuit elements are protected from very large quantities of heat evolved by the high voltage transformer. The magnetic card reader/writer may be provided for reading cooking program information from a magnetic card and writing the same on it. The microwave oven should be controlled according to the cooking program information for cooking purposes.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE INVENTION

First of all, any type of cooking utensil can have an arrangement for providing a cooling system and magnetic shield system according to the present invention so far as such a cooking utensil has a microwave oven function.

Figure 1:
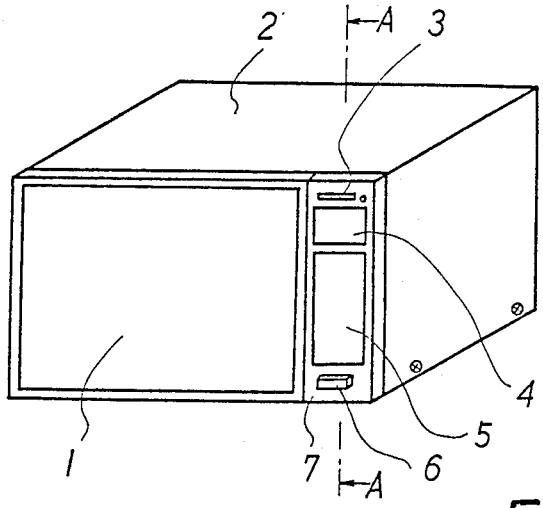
FIG. 1 is a perspective view of a microwave oven of the present invention.

FIG. 1 shows an embodiment of a microwave oven according to the present invention. The microwave oven comprises an oven door 1, a housing 2, and a control panel 7.

The control panel 7 includes a card inlet 3, a display 4, a and, a door switch 6. Through the card inlet 3, a magnetic card is inserted to provide cooking program information according to which the microwave oven is energized. The display 4 indicates cooking time period and a prescribed temperature up to which an object positioned in the microwave oven should be heated. The prescribed temperature is set by the cooking program information by means of the magnetic card. The display 4 comprises required digits each consisting of an alphanumerical configuration.

In place of the magnetic card, the keyboard 5 is alternatively operated to enter cooking program information. The keyboard 5 comprises a plurality of numerical keys and microwave output setting keys both operable for controlling the microwave energy. The door switch 6 is operated to allow the door 1 to be opened.

Figure 2:
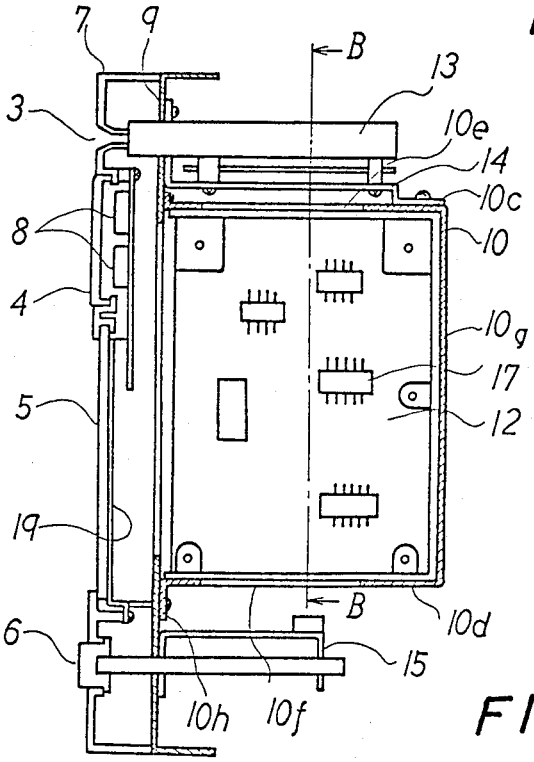
FIG. 2 is a fragmentary view on an enlarged scale in vertical section taken in the plane indicated by line A—A in FIG. 1 with certain portions broken away.
Figure 3:
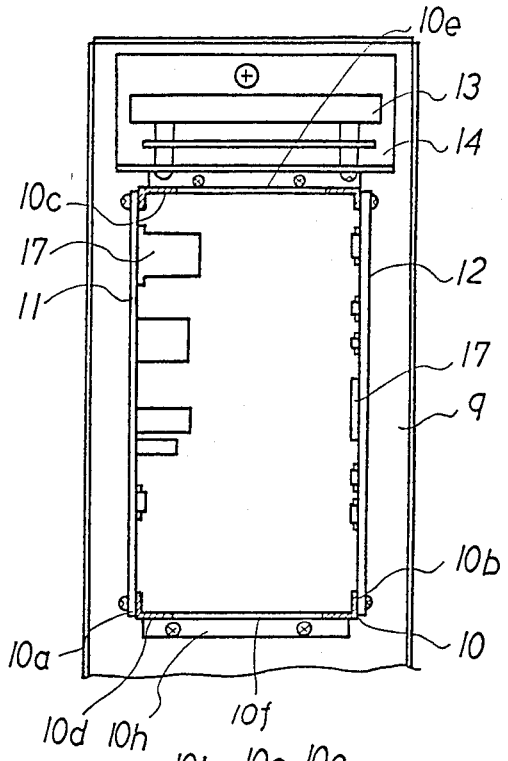
FIG. 3 is a sectional view taken in the plane indicated by line B—B in FIG. 2.

FIG. 2 is a sectional view taken in the plane indicated by line A—A in FIG. 1. FIG. 3 is another sectional view taken in the plane indicated by line B—B in FIG. 2. Like elements corresponding to those of FIG. 1 are indicated by like numerals.

With reference to FIGS. 2 and 3, there are provided a supporting plate 9, a circuit board supporting plate 10, two printed circuit boards 11 and 12, a card reader/-writer 13, a plurality of circuit elements 17, and a high voltage transformer 18.

The supporting plate 9 is disposed to support the control panel 7 in front of itself. The circuit board supporting plate 10 made of a metal is installed behind on the supporting plate 9. The circuit board supporting plate 10 sustains the card reader/writer 13 and the two printed circuit boards 11 and 12. The card reader/-writer 13 is operated to read/write the cooking program information.

Figure 4:
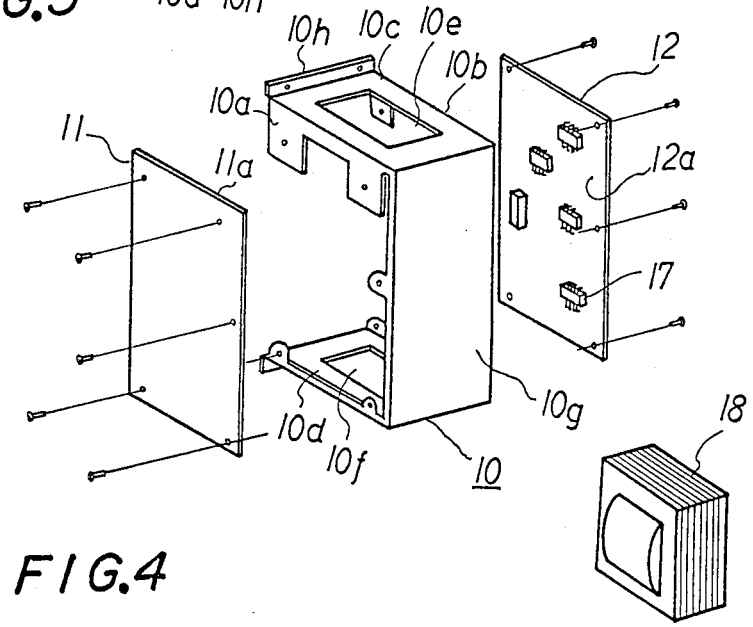
FIG. 4 is a perspective view of an arrangement for supporting a circuit board according to the present invention.

As shown in FIG. 4, the circuit board supporting plate 10 is shaped in a C-letter form. It sustains the two printed circuit boards 11 and 12 with the help of some screws. A top portion **10*c* and a bottom portion 10*d* of the circuit board supporting plate 10 form a pair of windows 10*e* and 10*f*. A rear portion 10*g* of it is opposed to the high voltage transformer 18. When operated, the high voltage transformer 18 evolves very large quantities of heat. The circuit board supporting plate 10 is secured to the supporting plate 9 at its front portion 10*h*** with the aid of screws.

The plurality of circuit elements 17 comprise a large scale integrated (LSI) semiconductor chip, a high voltage condenser, a diode, and a resistor etc. The circuit elements 17 are operated to energize a magnetron contained within the microwave oven.

Each of surfaces **11*a* and 12*a* of the two printed circuit boards 11 and 12 carries required circuit elements 17. The surfaces 11*a* and 12*a* are arranged so that they are opposed to each other in such a manner that the circuit elements 17 so carried are also opposed to each other. No circuit element is supported on the surfaces of circuit boards 11 and 12 opposite the surfaces 11*a* and 12*a*, respectively. The two printed circuit boards 11 and 12 are combined to side portions 10*a* and 10*b* of the circuit board supporting plate 10**, respectively, with the help of some screws.

Through a compartment formed by the rear portion **10*g* of the circuit board supporting plate 10, the two printed circuit boards 11 and 12, and the supporting plate 9, air passes from one of the windows 10*e* and 10*f* to the other of them. As a conventional cooling blower is normally provided for cooling the magnetron by air, the air is allowed to pass from the window 10*f* to the window 10*e*. Air required to pass through the compartment may pass near the high voltage transformer 18** prior to introduction to the compartment.

Above the top portion **10*c*, the card reader/writer 13 is secured by an L-shaped member 14. The L-shaped member 14 functions to protect the circuit elements 17 carried on the two printed circuit boards 11 and 12 from magnetic field caused in the card reader/writer 13. The L-shaped member 14 is a metallic plate. Below the bottom portion 10*d* of the circuit board supporting plate 10, door releasing elements 15 related to the door switch 6 are provided which allow the door 1 to be released or opened. The card reader/writer 13 and the door releasing elements 15 are separated from the top portion 10*c* and the bottom portion 10*d*, respectively, so that the air can pass through the interval. Behind the display 4, a plurality of indication elements such as an LED, a liquid crystal display and the like are arranged. The keyboard 5 is secured on the control panel 7 with the aid of a plate 19**.

In accordance with the above-mentioned arrangement, since the two printed circuit boards 11 and 12 are adhered to the circuit board supporting plate 10, the construction strength of the circuit board supporting plate 10 is assured. As the air flows through the compartment from the window **10*f* to the window 10*e*, the circuit elements 17 positioned within the compartment by fixing them on the printed circuit boards 11 and 12 are exposed to the air, with the result that they are cooled. It is arranged that the circuit elements 17 do not confront the high voltage transformer 18. They are protected from very large quantities of heat evolved by the high voltage transformer 18. Therefore, the operable temperature range of the circuit elements 17** is maintained.

Moreover, the circuit elements 17 held on the two printed circuit boards are magnetically shielded from the high voltage transformer 18 by the rear portion **10*g* of the circuit board supporting plate 10**.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A microwave oven which comprises:

a housing;

a door attached to the front portion of said housing;

a control panel disposed on said front portion of said housing adjacent to said door;

a circuit structure disposed behind said control panel, wherein said circuit structure comprises:

a C-shaped supporting member having upper and lower front portion plates secured to a rear portion of said control panel, at top portion plate and a bottom portion plate extending perpendicularly from said control panel, and a rear portion plate connecting said top and bottom portion plates opposite from said front portion plates, wherein said top and bottom portion plates each include top and bottom openings therein, respectively;

first and second printed circuit boards secured to first and second side portions of said C-shaped supporting members respectively, so as to form a compartment having said top and bottom openings, each of said first and second printed circuit boards having circuit elements disposed thereon so as to face into said compartment; and a high voltage transformer disposed behind said rear portion plate of said C-shaped supporting member, wherein said top and bottom openings in said C-shaped supporting member provide for air flow through said compartment so as to cool said circuit elements, said C-shaped supporting member reinforces the construction strength of said printed circuit boards, and said rear portion plate of said C-shaped supporting member shields said circuit elements from heat generated by said voltage transformer and from the magnetic field generated by said voltage transformer.

2. The microwave oven as defined in claim 1, wherein said C-shaped supporting member comprises a metallic plate.

3. The microwave oven as defined in claim 2, wherein said control panel comprises a keyboard and a display secured to a control panel support plate.

4. The microwave oven as defined in claim 3, wherein said control panel further comprises a card inlet for receiving cooking program information cards.

* * * * *